US006334810B1

(12) United States Patent
Song et al.

(10) Patent No.: US 6,334,810 B1
(45) Date of Patent: Jan. 1, 2002

(54) CHEMICAL MECHANICAL POLISHING APPARATUS AND METHOD OF USING THE SAME

(75) Inventors: Ju-hun Song, Kyungki-do; Jin-ok Moon, Seoul, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/484,534

(22) Filed: Jan. 18, 2000

(30) Foreign Application Priority Data

Apr. 10, 1999 (KR) ..... 99-12639

(51) Int. Cl.[7] ..... B24B 1/00
(52) U.S. Cl. ..... 451/60; 56/443; 56/444
(58) Field of Search ..... 451/36, 41, 56, 451/60, 59, 285, 286, 287, 288, 443, 444, 446

(56) References Cited

U.S. PATENT DOCUMENTS 5,931,725 A * 8/1999 Inaba et al. ..... 451/288
6,033,290 A * 3/2000 Gurusamy et al. ..... 451/56
6,113,468 A * 9/2000 Natalicio ..... 451/41

* cited by examiner

*Primary Examiner*—Derris H. Banks
*Assistant Examiner*—Dung Van Nguyen
(74) *Attorney, Agent, or Firm*—The Law Offices of Eugene M. Lee, PLLC

(57) ABSTRACT

A chemical mechanical polishing apparatus includes a polishing pad, a wafer carrier, a first ring, a second ring, a pad conditioning unit and at least one cleaning solution supply pipe. The first ring surrounds the semiconductor wafer and the edge of the wafer carrier. The second ring surrounds the first ring. The cleaning solution supply pipes are connected to the second ring and/or to the pad conditioning unit to supply the cleaning solution into the gaps between the rings, the wafer carrier and portions of the pad conditioning unit to remove solidified slurry from the gaps.

15 Claims, 3 Drawing Sheets

CHEMICAL MECHANICAL POLISHING APPARATUS AND METHOD OF USING THE SAME

BACKGROUND OF THE INVENTION

1. Field of the Invention

The present invention relates generally to a chemical mechanical polishing (CMP) apparatus, and more particularly, to a chemical mechanical polishing apparatus containing cleaning fluid conduits for suppressing micro scratches on a wafer.

2. Description of the Related Art

As the integration of semiconductor devices increases and multi-layered interconnections become widely used, the importance of local and global planarization of an interlevel dielectric layer becomes more important. A preferred planarization method is a chemical mechanical polishing (CMP) method, where a surface of a semiconductor wafer is polished using chemical components of a slurry solution supplied between the wafer and a polishing pad.

In general, CMP equipment includes a polishing platen unit, a polishing head unit and a pad conditioning unit. The polishing platen unit includes a polishing platen connected to a drive motor and a polishing pad on the polishing platen. The drive motor rotates the polishing platen and the pad.

The polishing head unit includes a wafer carrier supporting and applying pressure to the semiconductor wafer, a first ring surrounding the wafer carrier to prevent lateral deviation of the semiconductor wafer during polishing, and a second ring surrounding the first ring. The second ring contacts the polishing pad to improve the polishing profile of an edge portion of the semiconductor wafer.

The pad conditioning unit contains a pad conditioner head connected to a motor shaft, which moves the head over the polishing pad. The pad conditioner head supports a disk holder which includes a diamond disk suspended above the polishing pad. The motor shaft lowers the head toward the polishing pad such that the diamond disk contacts the polishing pad to maintain and/or condition the surface of the polishing pad.

In the above CMP apparatus, the semiconductor wafer is attached to the wafer carrier with the surface of the semiconductor wafer to be polished facing the surface of the polishing pad. The polishing pad and the semiconductor wafer are rotated during polishing. A polishing slurry is supplied during the polishing operation. During polishing, pressure is appropriately applied by the polishing head unit on the semiconductor wafer contacting a first region of the polishing pad to polish the surface of the semiconductor wafer. Meanwhile, the pad conditioning unit is positioned over a second region of the polishing pad so that the surface of the polishing pad is appropriately conditioned and/or maintained by the diamond disk.

However, the prior art CMP apparatus suffers from the following problem. During polishing using the above CMP apparatus, the slurry supplied on the polishing pad may splash up and infiltrate into the gaps and/or holes in the polishing head unit and/or in the pad conditioning unit. For example, the slurry may infiltrate into the gaps between the first ring and the second ring, between the first ring and the wafer carrier, between the pad conditioner head and the disk holder and/or into the holes in the second ring. The infiltrated slurry rapidly solidifies into flakes or particles in the gaps and/or holes.

Although the polishing head unit, the polishing pad and the pad conditioning unit are cleaned from the outside after a polishing cycle, the slurry cannot be properly and completely removed from the gaps and/or holes. During the next polishing cycle, the solidified slurry particles drop away from the gaps and holes where they solidified onto the polishing pad. The solidified slurry particles on the polishing pad contact the wafer being polished and cause micro scratches (i.e., undesirable defects) on the surface of the wafer being polished.

The present invention is directed to overcoming or at least reducing the effects of the problem set forth above.

SUMMARY OF THE INVENTION

In accordance with one aspect of the present invention, there is provided a chemical mechanical polishing apparatus, comprising a rotatable polishing pad, a wafer carrier facing in a direction of the polishing pad, at least one ring surrounding the wafer carrier and a first cleaning solution supply conduit located adjacent to the at least one ring for supplying a cleaning solution into at least one gap located in a region between the at least one ring and wafer carrier.

In accordance with another aspect of the present invention, there is provided a chemical mechanical polishing apparatus, comprising a rotatable polishing pad, a wafer carrier facing in a direction of the polishing pad and a pad conditioning unit, containing a pad conditioner head, a drive shaft connected to the pad conditioner head, a disk holder located below the pad conditioner head, such that a third gap is located between the disk holder and the pad conditioner head, a conditioning disk located below the disk holder and a second cleaning solution supply conduit for supplying a cleaning solution to the third gap.

In accordance with another aspect of the present invention, there is provided a method of polishing a substrate, comprising placing the substrate onto a carrier containing at least one ring, lowering the carrier to place the substrate in contact with a polishing pad, supplying a slurry to the polishing pad, rotating the polishing pad to remove a portion of the substrate and supplying a cleaning solution into at least one of (a) at least one gap located in a region between the at least one ring and the carrier to remove the slurry from the at least one gap and (b) a third gap located between a disk holder and a pad conditioner head of a pad conditioning unit to remove the slurry from the third gap.

BRIEF DESCRIPTION OF THE DRAWINGS

The above features and advantages of the invention will become apparent upon reference to the following detailed description of specific embodiments and the attached drawings, of which.

DETAILED DESCRIPTION OF THE PREFERRED EMBODIMENT

Korean Application Number 99-12639, filed Apr. 10, 1999, discloses the same subject matter as the present application and is hereby incorporated by reference as if fully set forth herein.

The chemical mechanical polishing apparatus according to one embodiment of the present invention includes a polishing pad, a wafer carrier, a first ring, a second ring and a cleaning solution supply pipe. The polishing pad is rotatably installed and contacts a surface of a semiconductor wafer during polishing. The semiconductor wafer is loaded into the wafer carrier such that the surface of the semiconductor wafer to be polished faces the polishing pad.

The first ring surrounds the semiconductor wafer and the edge of the wafer carrier, and rotates together with the semiconductor wafer and the wafer carrier during polishing to reduce or prevent lateral deviation of the semiconductor wafer. The second ring surrounds the first ring, forming a gap between the second ring and the first ring. The second ring contains a plurality of holes passing from an outer surface to an inner surface, and a bottom surface for contacting a part of the polishing pad to improve a polishing profile of the outer region of the semiconductor wafer.

The cleaning solution supply pipe is connected to at least one of the holes in the second ring to supply the cleaning solution into the holes and the gaps between the first ring and the second ring and between the first ring and the wafer carrier.

A chemical mechanical polishing apparatus according to another embodiment of the present invention includes a rotatable polishing pad for polishing a surface of a semiconductor wafer and a polishing head unit for loading the semiconductor wafer to face the surface of the polishing pad. The polishing head unit is capable of moving vertically and horizontally.

The apparatus also contains a pad conditioning unit for maintaining the surface of the polishing pad during polishing. The pad conditioning unit comprises a conditioning disk, a disk holder and a pad conditioner head. The disk contacts part of the surface of the polishing pad during polishing to condition the polishing pad, while the disk holder supports the disk. The pad conditioner head supports the disk holder and contains a pipe for supplying a cleaning solution to a gap between the disk holder and the pad conditioner head. Preferably, the disk is formed of a diamond material, and the pipe is connected to the cleaning solution supply unit through a motor shaft and the pad conditioner head.

Figure 1:
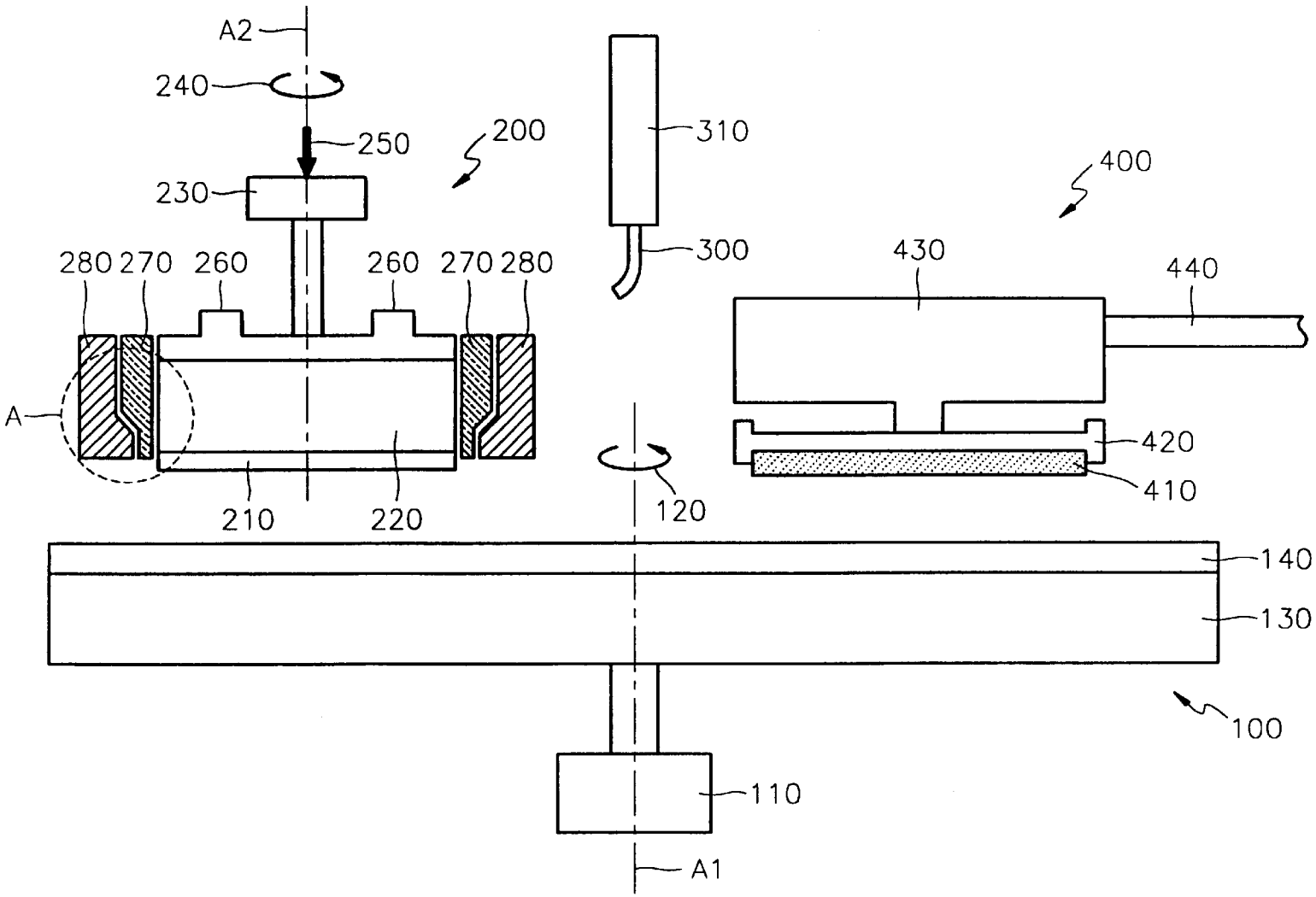
FIG. 1 is a cross-sectional view of a chemical mechanical polishing apparatus according to the present invention.

Referring to FIG. 1, the chemical mechanical polishing apparatus according to another embodiment of the present invention includes a polishing platen unit 100, a polishing head unit 200 and a pad conditioning unit 400.

The polishing platen unit 100 includes a polishing platen 130, a drive motor 110 capable of rotating the polishing patent 130 about shaft Al in the direction of arrow 120, and a polishing pad 140 installed on the polishing platen 130.

The polishing head unit 200 includes a wafer carrier 220 supporting a semiconductor wafer 210 to be polished. The wafer carrier 220 may support one or more wafers 210. A drive motor 230 rotates wafer carrier 220 about shaft A2 in the direction of arrow 240. However, a wafer carrier that lacks a drive motor for axial rotation is also within the scope of the present invention. The wafer carrier applies polishing pressure to the semiconductor wafer, as indicated by an arrow 250. The wafer carrier 220 may also include an optional back film for adsorbing the semiconductor wafer 210 and for buffering the polishing pressure, and an optional backing plate, such as a ceramic plate (not shown). A polishing housing 260, such as a metal housing, for supporting the wafer carrier 220 and for applying the polishing pressure, supports the wafer carrier 220. However, the housing and the wafer carrier may comprise a single unit, if desired.

The CMP apparatus also contains at least one ring. Preferably, the apparatus contains at least two rings 270 and 280. The first ring 270 may be used for guiding the semiconductor wafer 210 over the polishing pad 140. The first ring may be installed around the wafer carrier 220. A second ring 280 may be used for enhancing the polishing profile of the outer portion of the semiconductor wafer 210. The second ring 280 may be installed around the first ring 270.

Preferably, the first ring 270 rotates together with the wafer carrier 220 during polishing, while the second ring 280 remains stationary during polishing and contacts the polishing pad 140. A first gap is formed between the first ring 270 and the second ring 280, and a second gap is formed between first ring 270 and the wafer carrier 220. Furthermore, the second ring 280 may contain holes in its outer surface.

A storage reservoir 310 is used to supply a slurry 300 to the polishing pad 140. The slurry preferably comprises a chemical solvent and polishing particles for enhancing polishing of the wafer 210 by the polishing pad 140.

The pad conditioning unit 400 includes a disk holder 420 supporting a diamond disk 410 and a pad conditioner head 430 supporting the disk holder 420. A third gap is formed between the disk holder 420 and the head 430. The conditioner head 430 is connected to a motor shaft 440, preferably by its side surface. The motor shaft 440 is used to position the pad conditioner head over a predetermined region of the polishing pad 140 during polishing.

The polishing process using the CMP apparatus of FIG. 1 will now be described. First, the semiconductor wafer(s) 210 to be polished are stacked in a loading/unloading position in the polishing head unit, spaced apart from the polishing platen unit 100 by a predetermined distance. Then, the semiconductor wafer(s) 210 attached to the wafer carrier 220 are moved down to contact a first region of the polishing pad 140.

The pad conditioning unit 400 also moves down over a second region of the polishing pad 140 such that the diamond disk 410 contacts the polishing pad 140. The polishing platen unit 100 and the polishing head unit 200 are rotated by drive motors 110 and 230, and the surface of the semiconductor wafer 210 contacting the polishing pad 140 is polished, while the diamond disk 410 maintains and/or conditions the polishing pad 140.

As described above, during polishing, the slurry 300 may splash up from the surface of the polishing pad 140 and infiltrate into the first gap between the first ring 270 and the second ring 280, the second gap between the wafer carrier 220 and the first ring 270, the third gap between the disk holder 420 and the pad conditioner head 430 and/or into holes in the second ring 290. The infiltrated glurry is quickly solidified into particles or flakes. The solidified slurry may fall down to the polishing pad 140 during the next polishing process, causing micro scratches on the surface of the wafer(s) 210 being polished.

According to an embodiment of the present invention, a cleaning solution supply conduit is connected to at least one ring of the polishing head unit 200 and/or to the pad conditioning unit 400. The conduit is preferably a cleaning solution supply pipe and the cleaning solution is preferably purified or deionized water. However, other conduits or solutions may be used. The cleaning solution is used to remove the solidified slurry infiltrated into gaps or holes.

In a first preferred embodiment of the present invention, a first cleaning solution supply pipe 281 is connected to a hole (shown in FIGS. 2 and 3) in the second ring 280 where the slurry is easily infiltrated. In a second preferred embodiment of the present invention, a second cleaning solution supply pipe 450 is installed in the head 430 of the pad conditioning unit 400 (shown in FIG. 4).

Figure 2:
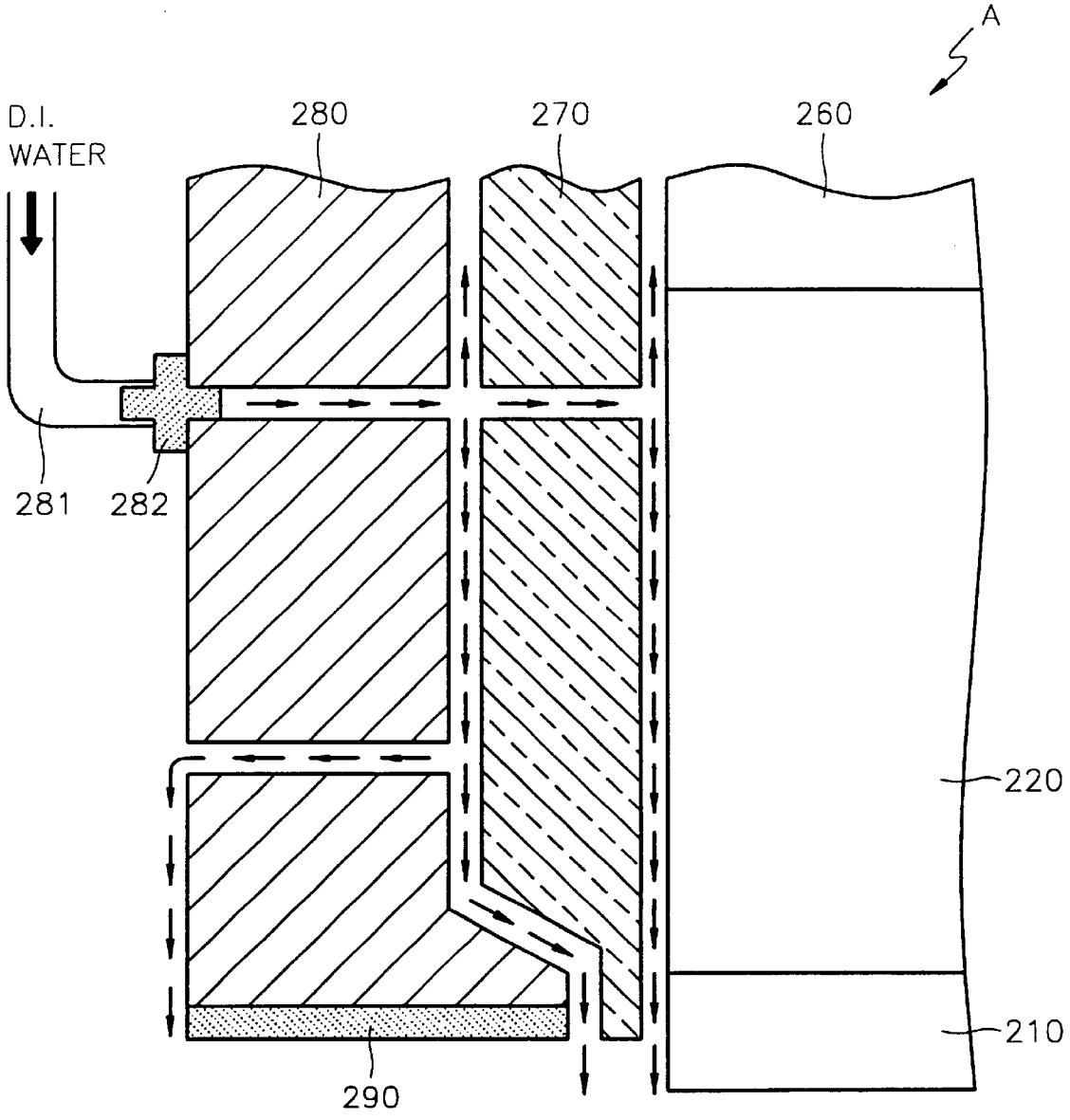
FIG. 2 is an enlarged cross-sectional view of the inner structure of portion A in FIG. 1.
Figure 3:
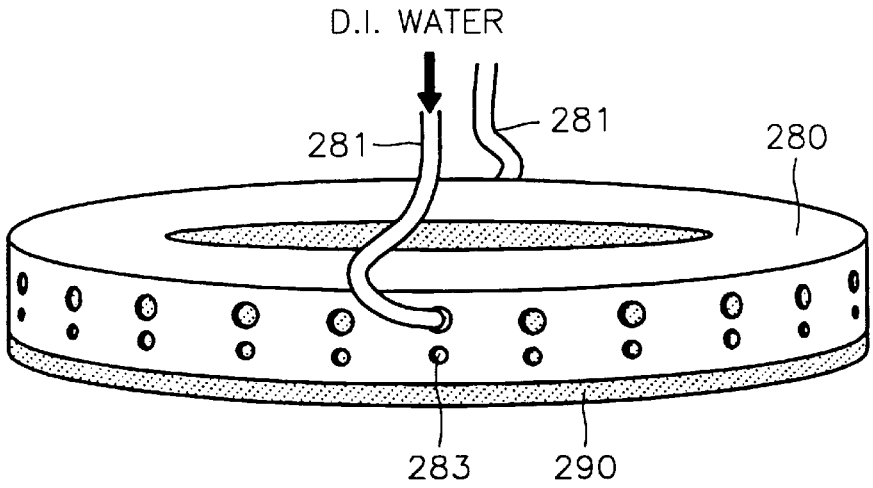
FIG. 3 is a three-dimensional perspective view of the second ring shown in FIG. 1.

FIG. 2 is an enlarged sectional view showing the inner structures of portion A of FIG. 1, i.e., the first and second rings 270 and 280, and FIG. 3 is a three-dimensional perspective view of the second ring 280 of FIG. 1.

Referring to FIGS. 2 and 3, the second ring 280 has a circular shape. The second ring 280 is preferably formed of a metallic material. The bottom surface of the second ring 280 may have an optional passivation layer 290 formed of a ceramic that contacts the polishing pad 140, to protect the polishing pad 140 (shown in FIG. 1) from direct contact with the metal ring 280.

The second ring 280 preferably contains a multiplicity of holes 283 that pass from the outer surface to the inner surface of the ring 280. The cleaning solution supply pipe 281 is connected to at least one hole. The cleaning solution supply pipe 281 is completely connected to the entrance of a hole 283 by a connection unit 282.

The method of operating the CMP apparatus according to the first preferred embodiment of the present invention will now be explained. First, the wafer(s) 210 are polished by contact with the polishing pad 140, as described previously. The polishing head unit 200 of FIG. 1 then moves up to a loading/unloading position after the polishing process, and the cleaning solution is supplied to a hole 283 through the supply pipe 281. The cleaning solution (i.e., deionized water) flows through the hole 283 into other holes 283 and into the first gap between the second ring 280 and 270 and the second gap between the first ring 270 and the wafer carrier 220, as shown by an arrows in FIG. 2. The flowing cleaning solution removes the slurry remaining in the holes 283 and in the first and second gaps. Thus, the solidified slurry is removed from the holes and the gaps, to thereby prevent it from falling onto the polishing pad 140 during a subsequent polishing step and to reduce or suppress the micro scratch defects in the wafer 210. The polishing pad 140 may be cleaned between the polishing cycles.

Preferably, the cleaning solution is supplied through the cleaning solution supply pipe 281 at the same time as the cleaning of the outside of the polishing head unit 200 of FIG. 1, while the polishing head unit is raised up in the loading/unloading position. However, the cleaning solution may be supplied before or after the outside cleaning step. Furthermore, while not a preferred embodiment, the cleaning solution may be supplied intermittently or continuously through pipe 281 during the polishing of the wafer 210 to prevent the slurry from penetrating, sticking in and/or solidifying in the gaps and holes described above. This would prevent the slurry from solidifying in the gaps and/or holes and failing back onto the polishing pad 140 during the same polishing step.

In FIGS. 2 and 3, the cleaning supply pipe 281 is shown as preferably being connected to a hole 283 in the second ring. However, the cleaning supply pipe may be located above the first gap between the first ring 270 and the second ring and/or above the second gap between the first ring 270 and the wafer carrier 220, to supply the cleaning solution directly into the gaps. Furthermore, there may be plural supply pipes 281, or the cleaning solution supply conduit may have a ring or shower head shape to supply the cleaning solution to the ring shaped (i.e., circular) gaps.

Figure 4:
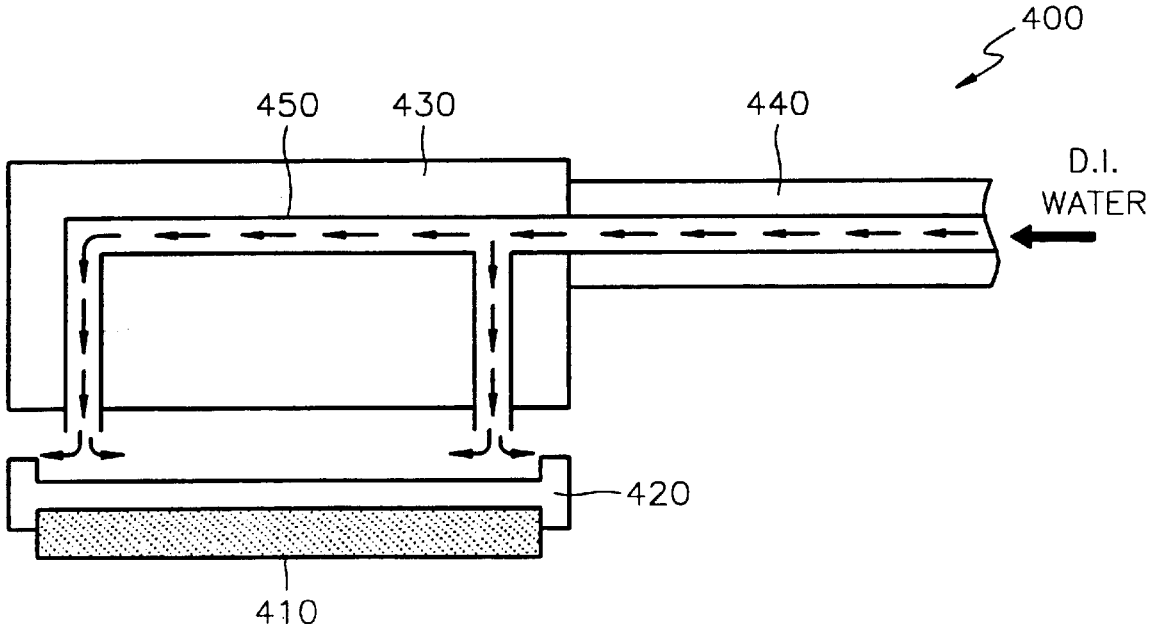
FIG. 4 is a cross-sectional view of an inner structure of a pad conditioning unit shown in FIG. 1.

In a second preferred embodiment of the present invention, a cleaning solution supply pipe 450 is installed to pass through the head 430 and the motor shaft 440 of the pad conditioning unit 400, as shown in FIG. 4. The cleaning solution supply pipe 450 is extended into the third gap between the disk holder 420 and the head 430 past the bottom surface of the head 430. The slurry infiltrated into the gap between the disk holder 420 and the head 430 can be removed using the cleaning solution from the supply pipe 450.

The method of operating the CMP apparatus according to the second preferred embodiment of the present invention will now be explained. First, the pad conditioning unit 400 of FIG. 1 is moved up away from the polishing pad 140 to a waiting position after the polishing step. At this time, the cleaning solution, i.e., pure or deionized water, is supplied through the cleaning solution supply pipe 450. The supplied cleaning solution flows into the gap between the disk holder 420 and the pad conditioner head 430 through the cleaning solution supply pipe 450. The cleaning solution removes the solidified slurry and prevents it from falling onto the polishing pad 140 during a subsequent polishing step, which reduces or suppresses the micro scratch defects on the wafer 210.

Preferably the cleaning solution is supplied through the cleaning solution supply pipe 450 at the same time as the cleaning of the outside of the polishing head unit 200 of FIG. 1, while the polishing head unit is raised up in the loading/unloading position. However, the cleaning solution may be supplied before or after the outside cleaning step. Furthermore, while not a preferred embodiment, the cleaning solution may be supplied intermittently or continuously through pipe 450 during the polishing of the wafer 210 to prevent the slurry from penetrating, sticking in and/or solidifying in the third gap described above. This would prevent the slurry from solidifying in the third gap and falling back onto the polishing pad 140 during the same polishing step.

In FIG. 4, the supply pipe 450 is shown as extending through the motor shaft 440 and the pad conditioner head 430 to the third gap above the disk holder 420. However, the supply pipe 450 may be located outside the motor shaft 440 and/or the pad conditioner head 430, as long as it is able to supply the cleaning solution to the third gap. Furthermore, there may be plural supply pipes 450, or the cleaning solution supply conduit may have a ring or shower head shape to supply the cleaning solution to the circular gap.

In a third preferred embodiment of the present invention, the CMP apparatus contains a cleaning solution supply conduit for supplying the cleaning solution to both the gaps and/or holes in the polishing head unit 200 and the pad conditioning unit 400. The cleaning solution may be supplied to units 200 and 400 at the same or different times.

The CMP apparatus of the present invention may be used to polish a bare substrate, such as a semiconductor wafer, or to planarize isolation or interlevel insulating layer(s) (i.e., silicon oxide or nitride layers that separate various metallization layers) of a semiconductor device, such as a field effect or a bipolar transistor, formed on a semiconductor wafer. The scope of the present invention also includes a method of making the semiconductor device using the CMP apparatus and the semiconductor device made by the method.

Thus, a CMP apparatus and method of using the same has been described according to the present invention. While the invention is susceptible to various modifications and alternative forms, specific embodiments have been shown by way of example in the drawings and described in detail herein. However, it should be understood that the invention is not limited to the particular forms disclosed. Rather, the invention covers all modifications, equivalents, and alternatives falling within the spirit and scope of the invention as defined in the appended claims.

We claim:

1. A chemical mechanical polishing apparatus, comprising:

a rotatable polishing pad;

a wafer carrier facing in a direction of the polishing pad;

a first ring surrounding the wafer carrier and a second ring, having at least a first hole, surrounding the first ring;

a first gap located between the first ring and the second ring and a second gap located between the first ring and the wafer carrier; and a first cleaning solution supply conduit located adjacent to the second ring for supplying a cleaning solution into at least one of the first gap and the second gap, wherein the first cleaning solution supply conduit comprises a first cleaning solution supply pipe connected to the first hole in the second ring, and wherein the first hole in the second ring is in fluid contact with the first gap and the second gap.

2. The apparatus of claim 1, wherein:

the second ring contains a plurality of holes; and the first hole is in fluid contact with at least a second hole, such that the cleaning solution can flow from the cleaning fluid supply pipe through the first hole into the second hole, the first gap and the second gap.

3. The apparatus of claim 1, wherein:

the wafer carrier is adapted to hold a semiconductor wafer;

the first ring rotates together with the wafer carrier during polishing; and the second ring remains stationary during polishing and a bottom surface of the second ring contacts the polishing pad during polishing.

4. The apparatus of claim 1, wherein:

the second ring comprises a metallic material; and the bottom surface of the second ring further comprises a ceramic passivation layer.

5. The apparatus of claim 1, further comprising a pad conditioning unit, containing:

a pad conditioner head;

a disk holder located below the pad conditioner head, such that a third gap is located between the disk holder and the pad conditioner head;

a conditioning disk located below the disk holder; and a second cleaning solution supply conduit for supplying the cleaning solution to the third gap.

6. The apparatus of claim 5, further comprising:

a first drive motor for rotating the polishing pad;

a second drive motor for rotating the wafer carrier;

a motor shaft supporting the pad conditioner head;

a polishing slurry reservoir; and wherein the second cleaning supply conduit comprises a second cleaning solution supply pipe extending through the pad conditioner head to the third gap.

7. A chemical mechanical polishing apparatus, comprising:

a rotatable polishing pad;

a wafer carrier facing in a direction of the polishing pad; and a pad conditioning unit, containing:

a pad conditioner head;

a drive shaft connected to the pad conditioner head;

a disk holder located below the pad conditioner head such that a third gap is located between the disk holder and the pad conditioner head;

a conditioning disk located below the disk holder; and a second cleaning solution supply conduit for supplying a cleaning solution to the third gap;

a first ring surrounding the wafer carrier and a second ring surrounding the first ring, such that a first gap is located between the first ring and a second ring and a second gap is located between the first ring and the wafer carrier;

at least one hole in the second ring;

a first cleaning solution supply pipe connected to a first hole in the second ling; and the first hole is in fluid contact with the first gap and the second gap.

8. The apparatus of claim 7, wherein the conditioning disk comprises a diamond material.

9. The apparatus of claim 7, wherein the second cleaning supply conduit comprises a second cleaning solution supply pipe extending through the pad conditioning head and the drive shaft to the third gap.

10. A method of polishing a substrate, comprising:

placing the substrate onto a carrier containing a first ring surrounding the carrier and a second ring surrounding the first ring and a first gap located between the first ring and a second ring and a second gap located between the first ring and the carrier;

lowering the carrier to place the substrate in contact with a polishing pad;

supplying a slurry to the polishing pad;

rotating the polishing pad to remove a portion of the substrate; and supplying a cleaning solution to the first gap to remove the slurry from the first gap, the second gap to remove the slurry from the second gap, a third gap located between a disk holder and a pad conditioner head of a pad conditioning unit to remove the slurry from the third gap, and a hole in the second ring.

11. The method of claim 10, further comprising a step of placing a second substrate onto the carrier after the step of supplying a cleaning solution.

12. The method of claim 10, further comprising the step of raising the carrier after the step of rotating the polishing pad; and wherein the step supplying a cleaning solution occurs after the step of raising the carrier to remove a solidified slurry.

13. The method of claim 10, wherein the step of rotating the polishing pad occurs simultaneously with the step of supplying the cleaning solution to prevent the slurry from solidifying in the at least one gap or in the third gap.

14. The method of claim 10, wherein the substrate comprises a semiconductor wafer.

15. The method of claim 14, wherein the step of rotating the polishing pad to remove a portion of the substrate comprises at least one of:

removing a portion of the semiconductor wafer;

removing a portion of an isolation layer formed over the semiconductor wafer; and removing a portion of an interlevel insulating layer over the semiconductor wafer.

* * * * *